United States Patent [19]

Dailey, III

[11] Patent Number: 4,863,064

[45] Date of Patent: Sep. 5, 1989

[54] FLEXIBLE DISPENSER PACKET FOR PRE-MOISTENED TOWELETTES

[75] Inventor: Robert Dailey, III, Jackson, Tenn.

[73] Assignee: IFC Non-Wovens, Inc., Jackson, Tenn.

[21] Appl. No.: 298,827

[22] Filed: Jan. 18, 1989

Related U.S. Application Data

[63] Continuation-in-part of Ser. No. 98,298, Sep. 18, 1987, abandoned.

[51] Int. Cl.[4] ..... A47K 10/24

[52] U.S. Cl. ..... 221/48; 221/63; 206/494

[58] Field of Search ..... 221/47–51, 221/61–63, 53–55

[56] References Cited

U.S. PATENT DOCUMENTS

| | | | |
|---|---|---|---|
| 2,640,587 | 6/1953 | Smith | 221/63 X |
| 3,243,078 | 3/1966 | Pherson | 221/48 |
| 3,780,908 | 12/1973 | Fitzpatrick et al. | 221/63 X |
| 3,836,044 | 9/1974 | Tilp et al. | 221/63 X |
| 3,836,045 | 9/1974 | Duhy | 221/63 |
| 4,131,195 | 12/1978 | Worrell | 221/63 X |
| 4,138,034 | 2/1979 | McCarthy | 221/63 X |
| 4,156,493 | 5/1979 | Julius | 221/63 |
| 4,200,200 | 4/1980 | Hein, III et al. | 221/63 X |
| 4,651,895 | 3/1987 | Niske et al. | 221/63 |

FOREIGN PATENT DOCUMENTS

| | | | |
|---|---|---|---|
| 84/02896 | 8/1984 | World Int. Prop. O. | 221/63 |

*Primary Examiner*—Joseph J. Rolla
*Assistant Examiner*—Gregory L. Huson
*Attorney, Agent, or Firm*—Felfe & Lynch

[57] ABSTRACT

The invention comprises a sealed flexible plastic packet having an opening through the top of said flexible packet container, a resealable tab in position to seal off said opening, said packet containing within it a rigid tray insert comprising a top and side walls and having a cavity comprising a base wall and peripheral walls extending from said base wall to said top of said rigid tray insert and said base wall having an opening transversely positioned relative to a presented edge of one of a plurality of disposable pre-moistened towelettes removably positioned in the space beneath said rigid tray insert, whereby access is provided through said opening to said towelette for removal of said towelette from said container such that upon removal of said towelette from said container the next succeeding towelette is presented for subsequent removal from said cavity.

3 Claims, 2 Drawing Sheets

FLEXIBLE DISPENSER PACKET FOR PRE-MOISTENED TOWELETTES

This application is a continuation of application Ser. No. 098,298, filed Sept. 18, 1987 now abandoned.

FIELD OF THE INVENTION

This invention relates to a packet dispenser containing pre-moistened towelettes in which the packet is formed from a flexible, moisture impervious material, said packet having an opening through which successive towelettes are successively dispensed. The aforementioned packet contains in addition a rigid insert positioned atop a stack of towelettes, said insert, when in place within the packet atop the stack of towelettes, having an opening therethrough which is located in alignment with the opening through said packet.

BACKGROUND OF THE INVENTION

In the art of dispenser packaging, structurally rigid containers with resealable lids for maintaining moistened tissues are well known. These contain a plurality of pre-moistened tissues stacked within a container or package having rigid top, bottom and side walls. Access to the towelettes is usually through a symmetrical opening in the top side of the rigid container; the opening is generally resealed by a cover extending directly over and beyond all sides of the opening.

An example of such dispenser construction is disclosed in U.S. Pat. No. 3,819,043 to Harrison. The dispenser pack has an opening covered by a flap in a top side of the container. The flap, having the same shape as the opening, may have a depression molded onto its bottom side. The flap self closes when allowed to return to a horizontal position, and the optional depression protrudes into the opening to further tighten the seal.

Further examples of access openings covered directly by extended flaps are shown in U.S. Pat. Nos. 4,420,080; 4,143,762; and 4,131,195.

Problems associated with these dispenser constructions are the bulky size of the rigid containers, the immediate exposure of the towelettes to moisture loss when the flap seal is left open or fails and the soiling of the towelettes during the opening and closing of the flap.

In the past, in order to combine the "pop up" feature with a high count number of towelettes contained within the dispensing unit, the towelettes were usually packaged in bulky containers center-wound on a roll and containing perforations which facilitated detachment of the individual towelettes when needed.

The present invention consisting of a flexible outer packet containing a rigid insert within to maintain the towelettes in place represents an improved portable dispenser pack which can be conveniently sealed to hold the moisture within the packet.

SUMMARY OF THE INVENTION

In its broadest aspects, this invention provides a sealed flexible outer plastic packet container having a bottom and a top, and a means to separate said bottom and said top to provide a space, an opening through the top of said flexible packet container, a resealable top in position to seal off said opening, said packet containing within, a rigid tray insert comprising a top and side walls and having a cavity comprising a base wall and peripheral walls extending from said base wall to said top of said rigid tray insert, a portion of said base wall resting in contact with having an opening transversely positioned relative to a presented edge of one of a plurality of disposable pre-moistened towelettes removably positioned in said space of said product beneath said rigid tray insert whereby access is provided to said towelette for removal of said towelette from said container such that upon removal of said towelette from said container the next succeeding towelette is presented for storage and subsequent removal from said cavity. The bottom edges of each of the side walls of the floating rigid tray insert extend an equal distance below the base wall, i.e., a sufficient depth to enclose only those towelettes located at the top of the stack of towelettes contained within the packet. The depth of the stack of towelettes in the packet is greater than the depth to which the bottom edges of each of the side walls extend so that as the towelettes are removed from the stack, the rigid floating tray rests on and remains in contact with the next succeeding top towelette in the stack as the stack of towelettes is depleted.

The packets according to the present invention are intended to provide towelettes for personal hygiene, primarily when soap and water are not available. Such a towelette normally consists of paper or non-woven fabric and is generally saturated with a cleansing agent or an antiseptic solution containing a mild cleansing component, an oil-replenishing agent preventing the skin from drying, a bactericide and possibly perfume.

The rigid plastic insert which is contained within the flexible packet rests on the topmost towelette and conforms generally to the shape and dimensions of the top of the packet. The sides of the insert are described as abbreviated and are formed with a continuous arcute course around the periphery of the top so as to enclose a number of towelettes at the top of the stack of towelettes enveloped within the packet.

The sides of the insert are referred to herein as "abbreviated" because they do not extend the entire depth of the packet containing the towelettes when full prior to use but only extend downward for such distance as to enable the stack of towelettes to be kept in alignment. The abbreviated side walls of the insert extend beyond the depth of the peripheral walls which determine the depth of the cavity.

The cavity referred to above is formed into the top of the rigid insert and comprises a bottom wall and peripheral walls which extend from said bottom wall to the top of said rigid insert, said bottom wall having an opening transversely positioned relative to a presented edge of the pre-moistened towelettes positioned beneath the insert. The opening in the bottom wall of the cavity in the insert is in substantial alignment with the opening in the top of the flexible packet.

The insert provides a convenient means which allows flexible packaging to be used with a high count put-up of interfolded wet wipes. The insert provides a restrictive pressure against the top of the stack of towelettes. This pressure causes the lead edge of the interfolded towelettes to shift from side to side as pulled from the pouch, and therefore, poviding the "pop out" dispensing feature which is unique to this flexible dispenser.

The invention embodied within the instant dispensing system provides a flexible dispenser that both "pops up" and concurrently permits the packaging of a high count number of wipes. In the prior art, the pop-up wet wipes were caused to pop up through the use of a small hole orifice used in conjunction with a roll of center-wound, perforated towelettes.

The compact and lightweight package of the present invention is more efficient than pop-up wet wipe alternatives currently packaged in heavy plastic canisters containing the center-wound, perforated roll towelettes.

Therefore, this invention creates new features and benefits to the user not currently available with other wet wipe dispensers.

BRIEF DESCRIPTION OF THE DRAWINGS

For a better understanding of the invention, together with other and further objects thereof, reference is made to the following description, taken in connection with the accompanying drawings, and its scope will be pointed out in the appended claims.

Referring now to the drawings.

DETAILED DESCRIPTION OF THE INVENTION

Figure 1:
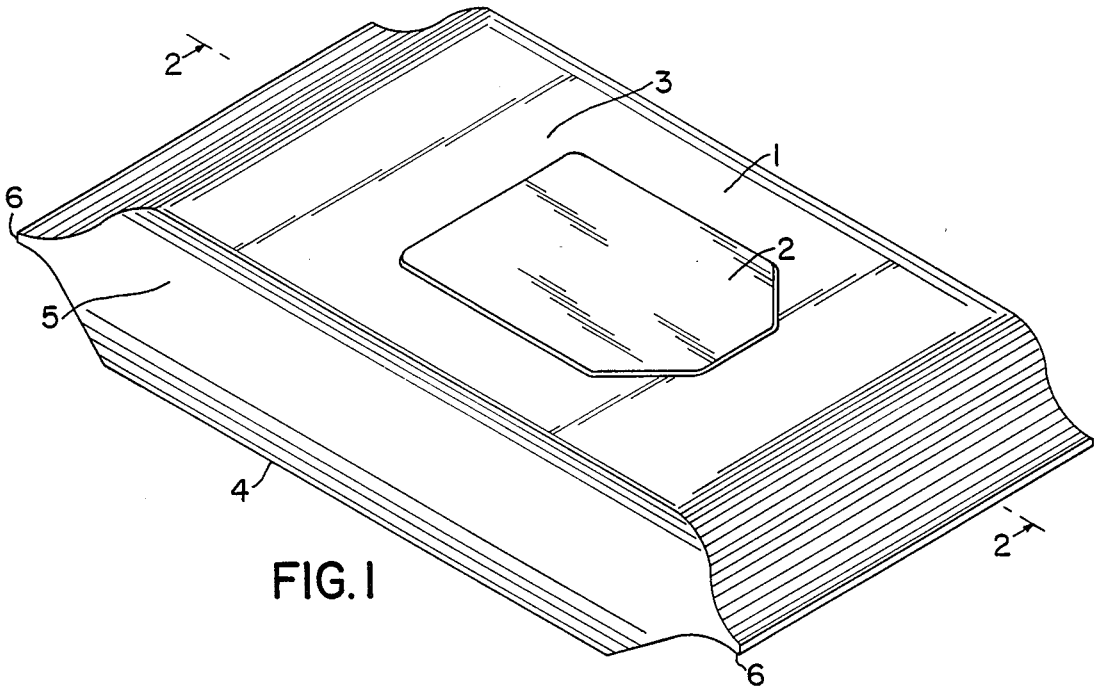
FIG. 1 is a perspective view of the packet.
Figure 2:
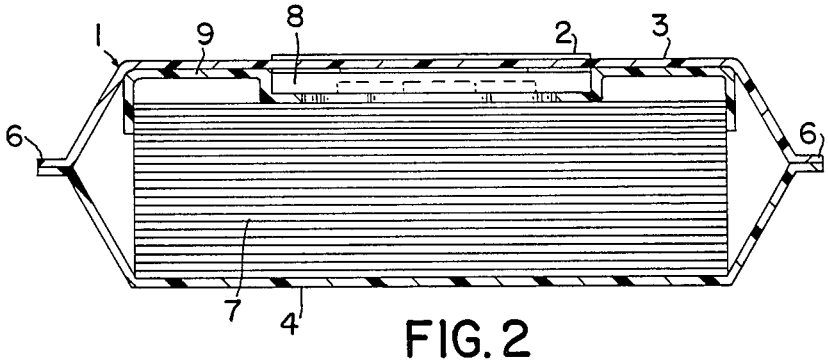
FIG. 2 is an cross sectional view of the dispenser along its length, illustrating its components including the rigid insert.

Referring to FIGS. 1 and 2, the present invention provides a flexible packet container for dispensing a quantity of pre-moistened towelettes or tissues which are contained therein having a resealable tab 2, which when removed reveals an opening through the packet 1 to allow the user to have access to the towelettes contained therein.

The packet 1 is preferably made from a highly moisture and vapor proof flexible plastic and has a top 3, bottom 4 and sides 5. Although a thermoplastic material, such as polyethylene or polypropylene, is preferred because it is inexpensive and easy to form, it may be appreciated that any material such as saran or a laminated metallized film which is moisture and vapor resistant may be used to produce the packet.

The material used should be of a grade approved for direct food contact so that toxic or hazardous contaminants will not leach into the towelettes to cause irritation or illness. The moisture-proof material preferably consists of a diffusion-tight plastic which is inert to the constituents of the moisturizing solution.

The resealable tab 2 which is made of highly moisture and vapor proof material is positioned so as to permit a sealing off of the opening on the top of the packet.

The moist towelettes used herein consist, for instance, of paper cloths or cloth of non-woven fabric. If the towelette shall be used for cleansing purposes, it can be impregnated with a cleansing, antiseptic solution, preferably a 15% ethanol solution containing a bactericide such as trichlorhydroxy phenyl ether or cetyl pyridin chloride and an agent reducing surface tension, such as an amphoteric tenside. The solution may also contain substances beneficial to the skin such as lanolin and isopropyl myristate, as well as perfumes such as menthol.

The flexible packet 1 is produced from a continuous wall of film which is formed into discrete packets having fin seals along the center bottom 4 of the packet (not shown) and end seals 6. The aforementioned seals can be effected either sonically or thermally as desired.

The towelettes are prefolded and packed such that they lay in direct contact with each other to form a stack. The towelettes should be interfolded in a "pop up" configuration. The term "pop up" in reference to towelettes is a term of art referring to the fact that the trailing edge of a removed towelette causes the leading edge of a subsequent towelette to protrude through an opening for use.

Access to the towelettes 7 in the packet 1 is gained through an opening beneath tab 2 which is found in cavity 8 located in rigid insert 9.

Figure 3:
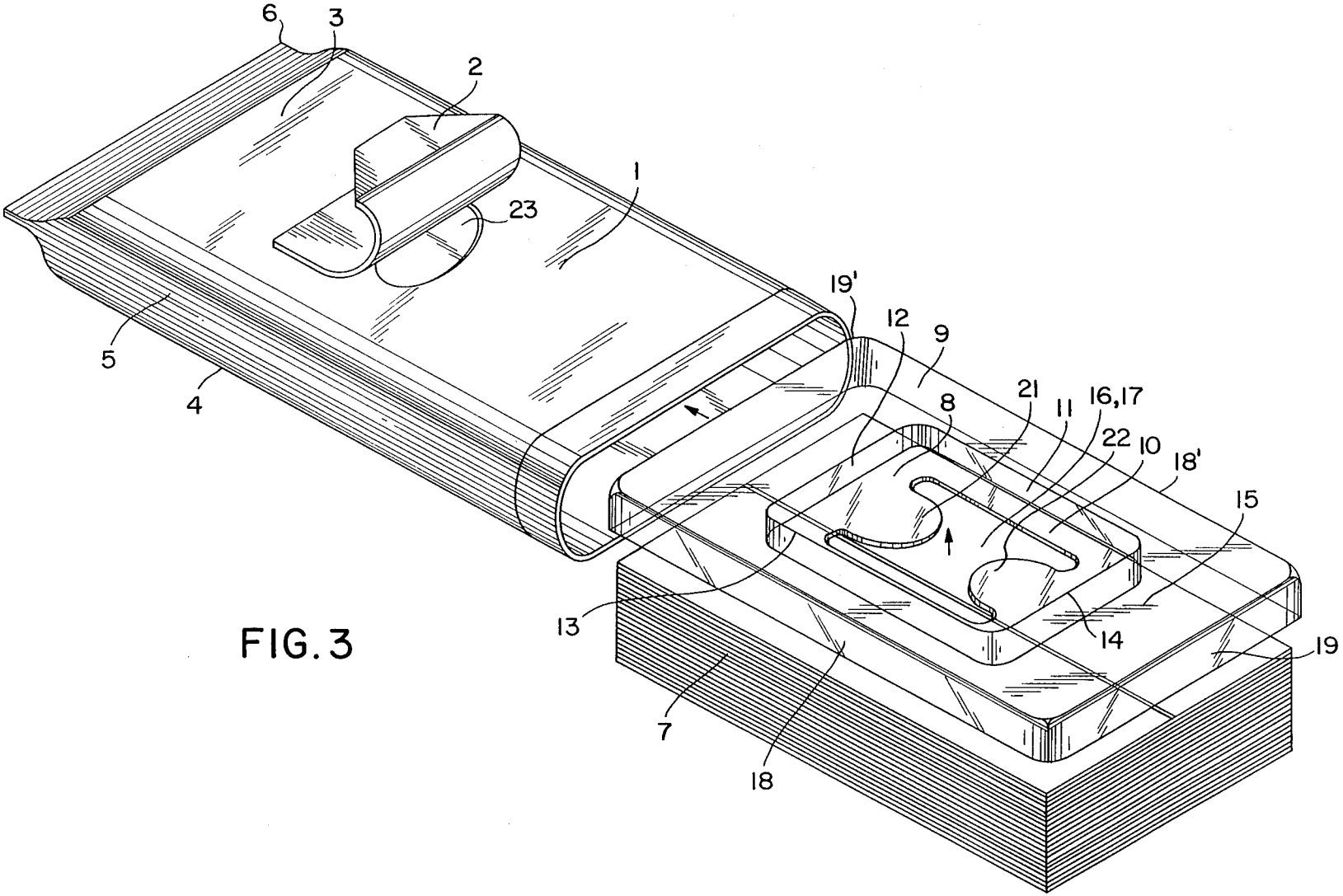
FIG. 3 is exploded perspective view, illustrating in detail the outer packet, sealing tab, insert and pre-moistened towelettes.

Referring to FIG. 3, inside of the sealed, flexible packet and immediately beneath the top 3 of said packet is positioned a rigid tray insert 9 which serves to provide structural reinforcement to the packet. Within the overall dimensions of the rigid insert 9, there is a cavity 8 formed by a bottom or base wall 10 and peripheral walls 11, 12, 13, 14 which extend from the bottom wall to the top 15 of the rigid insert. In the bottom wall 10 of the cavity, there is an opening 16 which provides access to the towelettes.

The rigid tray insert is preferably made of plastic such as polyethylene, polypropylene and polystyrene and conforms generally to the shape and dimensions of the top 3 of the flexible packet. The abbreviated sides 18, 18', 19, 19' of the insert 9 are formed with a continuous arcuate course around the periphery of the top so as to enclose a number of towelettes at the top of the stack of towelettes.

The rigid tray rests unencumbered on the top towelette of the stack and moves downward in the packet as the towelettes are removed therefrom.

The opening 17 through which the towelettes are dispensed comprises two parallel longitudinal slits separated from each other and connected at each of the ends of these longitudinal slits by two semi-circular sections which are diametrically opposite each other. The resulting transverse slit which connects the longitudinal slits is defined by two semicircular or parabolic shapes which are the mirror image of each other and thus is rounded and the opening is therefore a modified "H" configuration.

Opening 17 has the modified "h" type configuration described because it has been found that that particular rounded tabs 21 and 22 extending into the opening provide a configuration which resists removal of more than one tissue 7 at once by forcing a breakaway action when the tissue is subjected to a pulling force.

The tabs 21 and 22 forming a part of the modified H shape of the orifice in the plastic tray insert are flexible enough so as not to tear the wipes as they are being pulled from the packet, but rigid enough so that when this opening is positioned in the center on the top of the stack of interfolded wipes, it aids the wipes in shifting from side to side so the lead fold of the next wipe protrudes through either of the longer sides of the H opening.

The cavity 8 provides a space for the storage of the next towelette in line for removal so that it is immediately available and yet does not contact the seal tab 2 which covers the opening 23 through the top of the flexible packet 1.

Towelettes 7 are disposed in the packet 1 with their lengthwise edges along and within abbreviated insert sides 19, 19' parallel to the longitudinal dimensions of the "H" type opening such that an exposed edge of a top towelette 7 can protrude through opening 17 into cavity 8. As a result of this presentation, one may pull the exposed edge of the towelettes 7 to remove it through opening 17 from cavity 8 from opening 23, exposing thereafter the leading edge of the next towelette immediately behind it which then protrudes through opening 17 and is available for removal when the next tissue 7 is desired.

The cavity in the plastic tray insert provides not only a place in which to tuck the leading portion of the next wipe after a single wipe has been dispensed, but also holds that wipe in place so that when the reseal flap 2 is pulled back, the towelette is readily available in the opening 23 directly under the reseal flap. Also, although there are other reseal flaps now in use with similar pouch packages, there is no high count pop-up, flexible packet dispenser closed with a reseal flap which possesses the lightweight portability of the instant invention.

While there has been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What I claim and desire to cover by Letters Patent is:

1. A dispenser housing a plurality of pre-moistened towelettes comprising:

a sealed flexible outer packet having a bottom and a top, and a means to separate said bottom and said top to provide a space, an opening through the top of said flexible packet container, a resealable top in position to seal off said opening, said packet containing within said space, a rigid tray insert comprising a top and side walls and having a cavity comprising a base wall and peripheral walls extending from said base wall to said top of said rigid tray insert, a portion of said base wall resting in contact with and having an opening transversely positioned relative to a presented edge of one of a plurality of disposable pre-moistened towelettes removably positioned in said space of said packet beneath said rigid tray insert, whereby access is provided to said towelette for removal of said towelette from said packet, such that upon removal of said towelette from said packet the next succeeding towelette is presented for storage in and subsequent removal from said cavity; the bottom edges of each of said side walls of said rigid tray insert extending below said base wall a sufficient depth to enclose only those towelettes located at the top of the stack of towelettes contained within said packet; the depth of said stack of towelettes in said packet being greater than the depth to which said bottom edges of said side walls of said tray extend, so that, as towelettes are removed from said stack, said rigid tray rests on and remains in contact with the next succeeding top towelette in said stack as said stack of towelettes is depleted.

2. The packet defined in claim 1 wherein the packet has fin seals along the center of the bottom of said packet and along each end.

3. The packet defined in claim 1 wherein said opening in said rigid tray insert is a modified H.

* * * * *